United States Patent [19]

Vezirian et al.

[11] Patent Number: 4,703,849

[45] Date of Patent: Nov. 3, 1987

[54] VENDING PACKAGE

[76] Inventors: Edward Vezirian, 110 Firwood, Irvine, Calif. 92714; Earle L. Hinton, 851 Brighton, La Habra, Calif. 90631

[21] Appl. No.: 10,586

[22] Filed: Feb. 3, 1987

Related U.S. Application Data

[63] Continuation-in-part of Ser. No. 915,002, Oct. 3, 1986, which is a continuation-in-part of Ser. No. 876,725, Jun. 20, 1986.

[51] Int. Cl.[4] ..... B65D 77/00

[52] U.S. Cl. ..... 206/217; 206/19; 220/20

[58] Field of Search ..... 206/217, 19; 220/20, 220/22

[56] References Cited

U.S. PATENT DOCUMENTS

| | | | |
|---|---|---|---|
| 584,937 | 6/1897 | Hilliary | 206/217 |
| 2,096,825 | 10/1937 | Roman | 206/217 |
| 3,278,014 | 10/1966 | Thornton | 206/217 |
| 3,514,029 | 5/1970 | Powell | 206/217 |

FOREIGN PATENT DOCUMENTS

| | | | |
|---|---|---|---|
| 3242257 | 5/1984 | Fed. Rep. of Germany | 206/217 |

*Primary Examiner*—Joseph Man-Fu Moy

[57] ABSTRACT

A disposable individual serving dual compartment package for comestibles is disclosed, having a first compartment for a bread portion and a second compartment for a liquid portion, being directed toward the packaging of communion elements for use in religious services.

4 Claims, 4 Drawing Figures

FIG 2
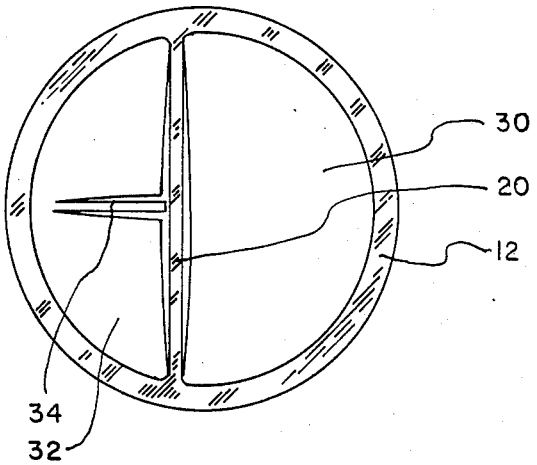
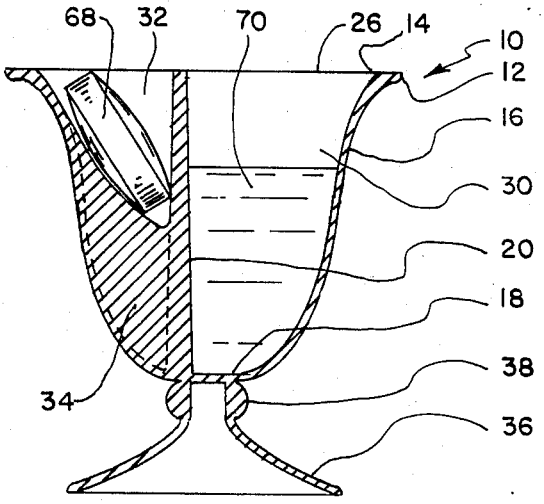
FIG 1
FIG 3
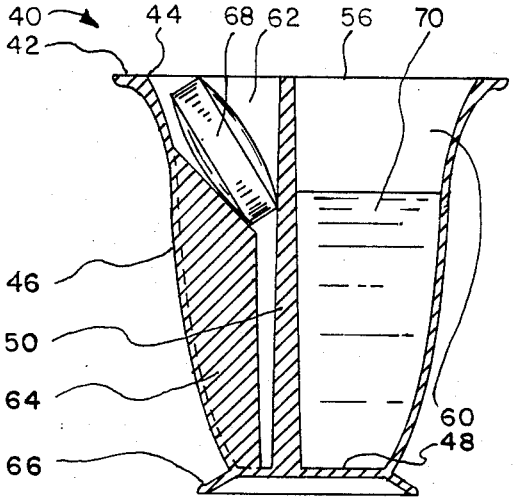
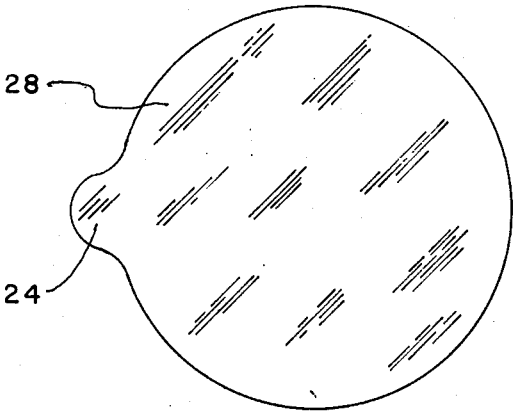
FIG 4

VENDING PACKAGE

This application is a continuation in part of application Ser. No. 6/915/002 filed 10/03/86, which is in turn a continuation in part of application Ser. No. 06/876,725 filed 06/20/86 each bearing the same title.

BACKGROUND OF THE INVENTION

1. Field of the Invention

This invention pertains to a package for purveying of individual servings of comestibles.

More specifically, this invention is directed to a dual compartment throwaway package for separately and sanitarily purveying two dissimilar comestibles, at least one of which is liquid. This invention is directed to an improved method of distributing Communion elements in religious services.

2. Brief Description of the Prior Art

The beverage industry and the canning industry have been largely founded on the concept of small disposable containers in which to package their products. Containers of ceramic clay or glass, employing cork stoppers for example, were probably the earliest such packages used, and were of a size to provide a small number of servings as to a family or small group. Pharmacists, distillers, and vintners found such packaging to be economical enough for their products. Brewers and soft drink manufacturers required convenience containers of smaller individual serving size. The Ball Mason glass jar and closure system brought the concept to home canning use. Metal tins found use in commercial canning, however the inappropriate use of such tins for continued storage of the contents after the seal had been broken led to many cases of food poisoning. Protective coatings for the inside of such tins, and the use of chemical preservatives have made the metal can a very popular container.

The fast food industry fostered the development of individual packages for dry items like sugar, salt and pepper, and then moist items like catsup, mustard, and relish. Such packages helped to solve problems of convenience, sanitation, and serving size in an economical manner.

Many family restaurants have found the advantages of the individual creamer, and the individual jam/jelly server to be of particular value in their operations.

A dual compartment package for the vending of a snack-sized portion of cheese spread in a first sealed compartment, and crisp fresh crackers in a second sealed compartment has been marketed for some time. This package is formed of light gage sheet plastic, and the two compartments are closed by means of a single impervious cover sheet which is heat sealed to the package.

The problems of the fast food industry in handling small amounts of comestibles to large numbers of people have been faced for centuries by churches in the distribution of communion elements.

SUMMARY OF THE INVENTION

An object of this invention is to provide a package which will offer the advantages of sanitary vending and individual convenience in the mass distribution of ceremonial food and drink items at religious services, for example, unleavened bread and grape juice or wine.

Another object of this invention is to eliminate the task of manually filling the great multiplicity of small cups used in such ceremonies, permitting the filling to be done well in advance and under sanitary conditions by modern high speed machines, avoiding common spills and waste.

Still another object of this invention is to provide a package which emulates the form of the classical chalice.

Individual cups have an outer parametric flat annular lip at the top and an outer first wall extending downwardly and inwardly from the inner edge of the parametric flat annular lip to a central bottom thus defining a cup. This cup is divided by a vertically oriented partition into two separate chambers. The partition extends across the cup from one outer wall to the other, and extends between the bottom of the cup and the plane defined by the outer parametric flat annular lip and presenting within that plane a top surface area sufficient to permit a sound and reliable bond thereto for a gas and moisture impervious closure membrane to seal and isolate the two chambers from one another.

The first chamber is intended to house the liquid comestible element. The second chamber, intended to house the solid comestible element, features a centrally disposed support means provided to support the solid comestible near the upper portion of the cup for ease in timely grasping and removing the comestible.

A stem extends downward from the central bottom of the cup to form a terminal pedestal flange. The design of the exterior portion of the cup is optionally determined by esthetics or economics, or to the stability of the cup as it rests on a table, for example. It should be noted that this method of partitioning the cup makes practical the use of a slender stem so that the total cup may be formed to emulate a classical chalice.

The cup, intended to be a disposable single serving container, may be formed of a thermoplastic; polystyrene or polyethylene for example.

After the cup is filled, a gas and moisture impervious closure membrane sheet is heat sealed to the continuous surface of the annular lip and the top of the partition at the top of the cup, to separately contain and preserve the comestibles within. The closure sheet is equipped with a pull tab to provide for its easy, convenient, and timely removal. The closure sheet is typically a membrane of thermoplastic, thermoplastic coated paper, paper-backed foil or plain foil treated with a heat activated adhesive. The use of such an adhesive, however, is less than desirable in that it tends to leave objectionable deposits on the rim of the cup over which the user will drink.

An advantage of this invention is that the packages may be quickly and easily refrigerated due to the small size of the portions, and to the relatively large surface area presented by the thin cup between the contents and the cold air of the refrigerator.

Another advantage of this invention is that unused portions are easily and conveniently returned to the storage refrigerator to be used in later ceremonies, whereas in the prior art it proved to be more realistic to discard the remaining portions.

The above noted objects and advantages of the present invention will be more fully understood upon a study of the following detailed description in conjunction with the detailed drawings.

BRIEF DESCRIPTION OF THE DRAWINGS

FIG. 1 is a cross sectional view of the preferred embodiment of the dual compartment disposable package, with a short slender stem and a pedestal flange at the base. The cup is shown filled but unsealed.

FIG. 2 is a top view of the open dual chamber package showing the parametric annular lip and the dividing partition along with a gusset across the second chamber for supporting the solid comestible for easy access. The cup is shown unfilled for clarity.

FIG. 3 is a cross sectional view of another embodiment of the invention. A partial gusset is shown supporting the bread portion in an unstemmed cup.

FIG. 4 is a plan view of the membranous closure sheet, showing the pull tab provided to facilitate opening the serving package.

DESCRIPTION OF THE PREFERRED EMBODIMENTS AND BEST MODE FOR CARRYING OUT THE INVENTION

Referring now to FIG. 1, a dual chamber, individual serving, disposable food package, is generally designated as 10. An outer wall 16 extends downward from an inner edge 14 of an outer parametric flat annular lip 12 to a central cup bottom 18.

Partition 20 extends across the cup between two points on outer wall 16, and extends between cup bottom 18 and the plane 26 defined by the upper surface of outer parametric flat annular lip 12, presenting sufficient area within plane 26 to provide a flat sealing surface for closure sheet 28, (not shown). First chamber 30 is provided to house the liquid comestible 70, and second chamber 32 is provided to house the solid comestible 68. Gusset 34 extends at least in part across second chamber 32 and serves to support the solid comestible 68 near the top of the cup 10 for easy and timely recovery by the user. The solid comestible 68 may be rotated causing it to be elevated by a camming action against the top of gusset 34 permitting the solid comestible to be easily grasped for removal from the second chamber 32 without spilling the liquid comestible from first chamber 30, it being noted that the solid comestible is taken prior to the liquid portion.

A stem 38 extends downward from cup bottom 18 to form pedestal base 36, providing a cup 10 with a form emulating a classic chalice, and providing a convenient and stable base.

FIG. 2 shows, by way of a top view, the relative positions of parametric flat annular lip 12 and partition 20 as well as of the gusset 34, extending substantially across second chamber 32.

FIG. 3 illustrates another embodiment of the invention and shows one form of a partial gusset 64 in an unstemmed cup, generally indicated as 40. An outer wall 46 extends downward from an inner edge 44 of an outer parametric flat annular lip 42 to a central cup bottom 48.

Partition 50 extends across the cup between two points on outer wall 46, and extends between cup bottom 48 and the plane 56 defined by the upper surface of outer parametric flat annular lip 42, presenting sufficient area within plane 56 to provide a flat sealing surface for closure sheet 28, (not shown). First chamber 60 is provided to house the liquid comestible 70, and second chamber 62 is provided to house the solid comestible 68. Partial gusset 64 extends from outer wall 46 toward partition 50 part way across second chamber 62 and serves to support the solid comestible 68 near the top of the cup 40 for easy and timely recovery by the user. Pedestal flange 66 extends downwardly and outwardly from outer wall 46 from the vicinity of cup bottom 48.

FIG. 4 shows a plan view of the thin membranous closure sheet 28. Thermoplastic or thermoplastic coated paper is the preferred material for manufacture of this closure sheet in that such materials may be readily heat sealed to the dual chambered thermoplastic cup thus eliminating the need of an adhesive layer on the closure sheet. Adhesives often leave some residue on the annular lip which may be perceived as unpleasant when drinking the liquid portion contained in the first chamber 30 of the dual package. Pull tab 24 is formed on the periphery of closure cover 28 as an aid in opening the serving package.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A dual compartment disposable individual serving comestibles package for sanitarily purveying a pair of separate and dissimilar portions comprising:
   - an outer parametric flat annular lip,
   - an outer wall extending downwardly and inwardly from an inner edge of said flat annular lip to a central bottom, thus defining a cup,
   - a vertically oriented partition extending across said cup and extending from said bottom to a plane defined by said parametric flat annular lip, presenting within said plane a top surface area being continuous with said parametric flat annular lip, said partition dividing said cup into a first chamber for housing a liquid comestible portion, and a second chamber for housing a solid comestible portion,
   - means to support said solid comestible portion near an open top of said second chamber wherein said means to support said solid comestible presents a surface adapted to cooperate with a rotation of said solid comestible so as to cam said solid comestible partially above said open top of said second chamber, and
   - a separate gas and moisture impervious membranous closure sheet adapted to be bonded to said continuous area of said flat annular lip and said top area of said partition, thus to separately retain and preserve said comestibles within said disposable individual serving package.

2. The invention as described in claim 1 wherein said closure sheet forms a pull tab outboard of said first annular lip to aid in removal of said closure sheet.

3. A dual compartment disposable individual serving comestibles package for sanitarily purveying a pair of separate and dissimilar portions comprising:
   - an outer parametric flat annular lip,
   - an outer wall extending downwardly and inwardly from an inner edge of said flat annular lip to a central bottom, thus defining a cup,
   - a vertically oriented partition extending across said cup and extending from said bottom to a plane defined by said parametric flat annular lip, presenting within said plane a top surface area being continuous with said parametric flat annular lip, said partition dividing said cup into a first chamber for housing a liquid comestible portion, and a second chamber for housing a solid comestible portion, means to support said solid comestible portion near an open top of said second chamber wherein said means to support said solid comestible presents a surface adapted to cooperate with a rotation of said solid comestible so as to cam said solid comestible partially above said open top of said second chamber.

a stem extending downward from said central bottom of said cup to form a terminal pedestal flange, and a separate gas and moisture impervious membranous closure sheet adapted to be bonded to said continuous flat annular lip and said top area of said partition, thus to separate, retain, and preserve said comestibles within said disposable individual serving package.

4. The invention as described in claim 3 wherein said closure sheet forms a pull tab outboard of said first annular lip to aid in removal of said closure sheet.

* * * * *